United States Patent [19]

Sommers

[11] Patent Number: 4,871,341

[45] Date of Patent: Oct. 3, 1989

[54] PUPPET MOUTH CONSTRUCTION

[75] Inventor: Valerie D. Sommers, Jackson, Mich.

[73] Assignee: National Child Safety Council, Jackson, Mich.

[21] Appl. No.: 267,321

[22] Filed: Nov. 4, 1988

[51] Int. Cl.[4] ..... A63H 3/14; A63H 3/36

[52] U.S. Cl. ..... 446/329; 446/338; 446/395

[58] Field of Search ..... 446/220, 226, 327, 328, 446/329, 338, 369, 370, 371, 372, 391, 395

[56] References Cited

U.S. PATENT DOCUMENTS

| | | | |
|---|---|---|---|
| 1,028,068 | 5/1912 | Hanley | 446/329 |
| 1,916,578 | 7/1933 | Marcus | 446/395 |
| 2,709,319 | 5/1955 | Baltin | 446/329 |
| 3,226,849 | 1/1966 | Rosen | 446/329 |
| 3,521,399 | 7/1970 | Deal | 446/329 |
| 3,747,264 | 7/1973 | Brandwein | 446/329 |
| 3,916,537 | 11/1975 | Gilligan | 446/329 |
| 3,942,283 | 3/1976 | Rushton | 446/369 |
| 4,365,353 | 12/1982 | Rayl | 40/586 |
| 4,555,236 | 11/1985 | Peyton | 446/329 |

*Primary Examiner*—Robert A. Hafer
*Assistant Examiner*—Michael Brown
*Attorney, Agent, or Firm*—Beaman & Beaman

[57] ABSTRACT

The invention pertains to a mouth for a puppet capable of being hand operated and the method for forming the same. A pair of identical semi-rigid pieces having a lip region periphery have separate layers of fabric sewn to the pieces adjacent the lip periphery and one of the fabric layers is slit and pulled over the periphery to enclose the edge. The pieces are sewn together to define a hinge, and the assembly is mounted upon plates within a puppet mouth opening.

6 Claims, 2 Drawing Sheets

PUPPET MOUTH CONSTRUCTION

BACKGROUND OF THE INVENTION

Hand puppets often include a mouth opening having a flexible mouth member which may be manipulated by a hand inserted through the back of the puppet's head. In this manner the mouth may be opened and closed, and otherwise manipulated to simulate talking and facial expressions.

In the past, puppet mouth openings are usually closed by flexible fabric, and such fabric does not have sufficient body and rigidity to effectively hold the shape of a mouth and define a tongue, teeth or other features normally found in the mouth. Also, previous puppet mouth constructions have difficulty in producing a manipulative mouth which is capable of maintaining a constant smiling appearance.

It is an object of the invention to provide a puppet mouth construction and the method of forming the same, wherein the puppet mouth is of a semi-rigid construction yet is easily manipulated by the operator's hand.

An additional object of the invention is to provide a puppet mouth of a semi-rigid construction which may be readily hand manipulated and which includes lip regions and inner mouth regions readily defined by different colored fabrics as to produce an attractive contrast adjacent the mouth opening.

Yet another object of the invention is to provide a manipulative mouth construction for a hand puppet wherein the mouth is of a semi-rigid form capable of maintaining a constant puppet facial expression, and wherein, the mouth will normally assume an open condition when not in use.

An additional object of the invention is to provide a manipulative puppet mouth construction wherein lip regions are clearly defined, which may be readily assembled and maintained within the puppet mouth opening, and which is economical to manufacture and install.

In the practice of the invention a pair of semi-rigid pieces of base material, such as cardboard, are placed upon superimposed layers of contrasting fabric, such as red and black flannel the red flannel being disposed adjacent the cardboard material. The cardboard base material includes a lip region periphery, usually a circular segment, and the remainder of the peripheral region substantially defines a linear diameter of the peripheral lip configuration.

The fabric layers are sewn to the base material adjacent the lip peripheral region, and the layers are trimmed adjacent the base material lip region and the inner linear periphery. Thereupon the black fabric is slit from its inner linear edge to approximately, but short of, the base material peripheral lip region. Several slits are utilized. Thereupon, the black fabric portions are pulled over the base material lip region periphery to form a bead, and the bead is sewn to the base material to maintain the "pulled over" relationship of the black fabric to the lip region. The extraneous black material is then removed.

The two identical base material pieces so constructed are then placed in aligned superimposed relationship with the red flannel layers contiguous, as are the beads defined at the lip regions, and a hinge line is defined by a sewn seam slightly spaced inwardly of the inner linear base material edge, and substantially parallel thereto.

The resultant mouth assembly is then glued within the puppet mouth opening which includes mouth plates sewn to the fabric of the puppet face adjacent the mouth opening, and the mouth assembly is so positioned that the beads overlap the puppet face fabric adjacent the mouth opening to define lips of contrasting color and the mouth assembly completely closes the puppet mouth opening.

Upon the user inserting a hand within the puppet's head the fingers may be placed upon the upper mouth plate, while the thumb engages the lower plate and in this manner the mouth assembly may be opened and closed to simulate mouth movement during talking.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
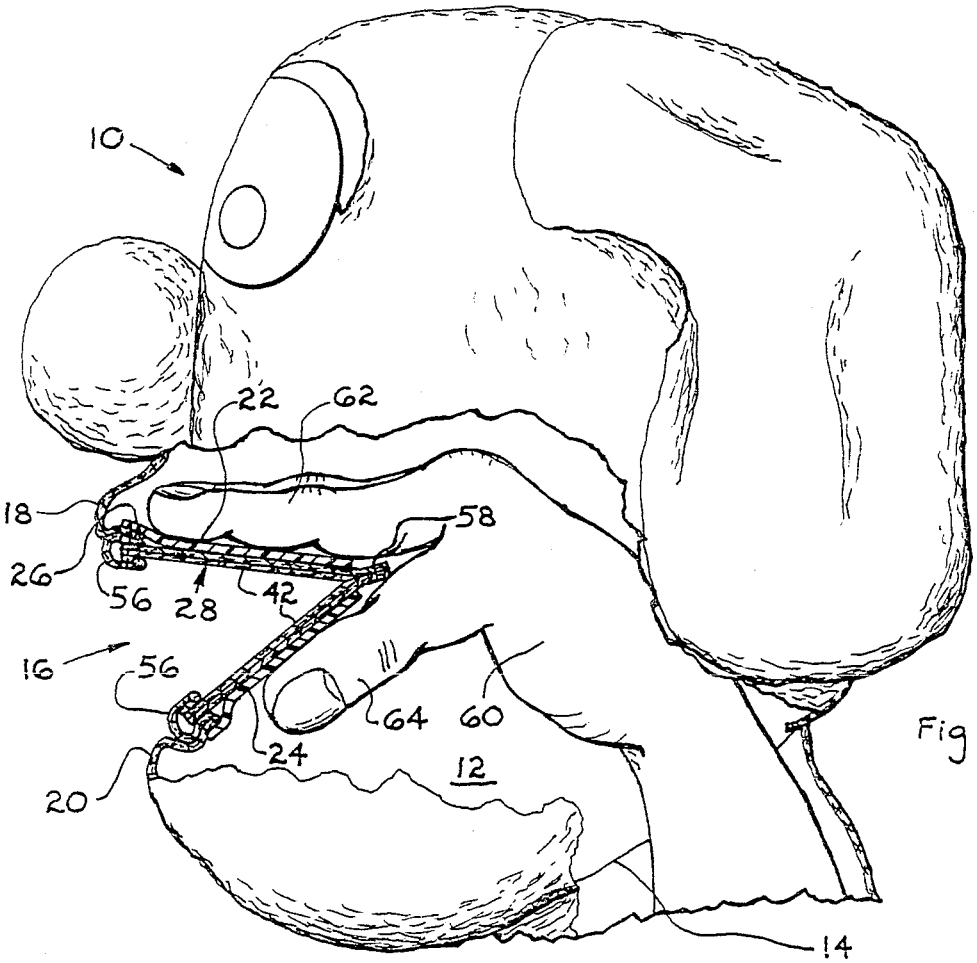
FIG. 1 is an elevational view, partially in section, illustrating the head of a puppet incorporating the mouth construction of the invention, the operator's hand being shown in position.
Figure 2:
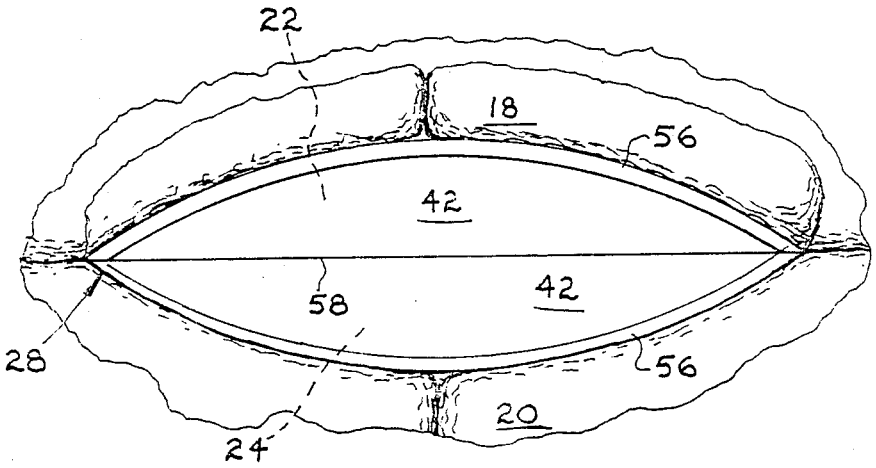
FIG. 2 is a detail, enlarged, front elevational view of the puppet mouth as taken from the left of FIG. 1.

FIG. 1 illustrates a typical head of a hand puppet with which the concepts of the invention may be employed. The head, generally designated at 10, which in the illustrated embodiment resembles a dog, is relatively hollow and includes a cavity 12 having a rear access hand opening 14 whereby the user's hand may be placed within the head cavity. The head also includes a mouth opening 16 defined by an upper lip region 18 and a lower lip region 20. Preferably, the head 10 is formed of a fabric and the lip regions 18 and 20 are formed of a plush fabric material.

Relatively stiff or semi-rigid mouth plates 22 and 24 are sewn to the lip regions 18 and 20, respectively, by seams 26. The mouth plates may be formed of a cardboard, plastic, expanded hardened foam, or the like. As will be later described, the mouth assembly is affixed to the mouth plates.

The mouth assembly in accord with the invention is generally indicated at 28 and consists of a pair of base material pieces having fabric affixed thereto as described. The construction of the mouth assembly 28 will be appreciated from FIGS. 3–11 as set forth below.

It is to be understood that in the following description of the mouth assembly only one particular manner for forming the mouth is disclosed and it is possible to practice the invention even though minor variations in the sequence of steps takes place.

The mouth assembly includes a pair of identical base material pieces 30 and 32 which are of a generally semicircular configuration. The base material pieces are formed of a relatively stiff semi-rigid material, such as cardboard, or heavy paperboard, which is sewable as threaded seams are preferably used for the assembly. However, it is to be understood that the base material pieces could be formed of a rigid material which is nonsewable but wherein adhesives or other bonding means could be used to interconnect the components, rather than a sewn seam.

The base material pieces each include a flat inner side 34 and the opposite outer side 36. The lip peripheral region 38 is of a circular configuration, but could be of other shapes, and the illustrated shape of the lip region is not to be construed in a limiting manner. Each base material piece also includes a linear peripheral region 40 which is in a spaced opposed relationship to the lip peripheral region 38 and, as will be appreciated, substantially constitutes a diameter with respect to the associated peripheral region 38.

The base material pieces 30 and 32 are placed on pair of fabric panels 42 and 44. These panels may be formed of a variety of fabrics or fabric-like material, such as vinyl, leather, nonwoven material, or the like. In one commercial embodiment of the invention the fabrics are of a flannel type consistency and the panel 42 is red, while the panel 44 is black in order to provide contrasting colors for a reason later described.

The base material pieces 30 and 32 are affixed to the fabrics 42 and 44 by a sewn seam 45. The seam 45 is located adjacent the lip peripheral region 38, but does not extend adjacent the linear peripheral region 40.

Figure 3:
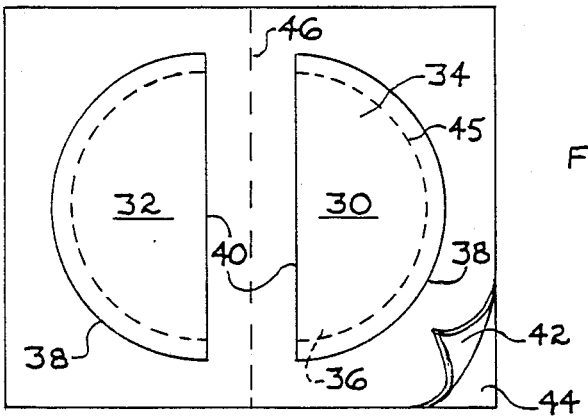
FIG. 3 is a plan view of the first step in forming the mouth structure illustrating two identical base material pieces lying upon a pair of superimposed fabric layers, the layers being sewn to the pieces adjacent the lip peripheral region.
Figure 4:
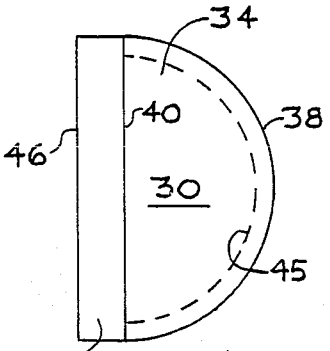
FIG. 4 is a plan view of a base material piece after trimming.

After the seam 45 is completed the assembly of FIG. 3 is cut with a scissors, or the like, at 46, FIGS. 3 and 4. Additionally, the fabric is trimmed adjacent the lip peripheral region 38 so that the edge of the fabrics 42 and 44 is flush with the periphery 38 as shown in FIG. 4.

Figure 5:
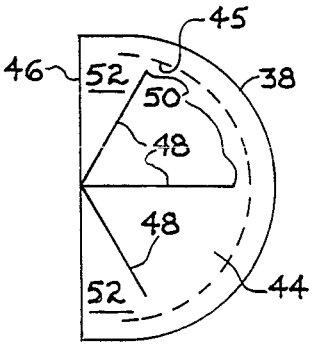
FIG. 5 illustrates the reverse side of the assembly of FIG. 4 upon the outer fabric layer being slit and prior to being pulled over the lip peripheral region.

FIG. 5 represents the reverse side of the assembly shown in FIG. 4 of a single base material piece 30 wherein the fabric 44 is disposed toward the viewer. The fabric 44 is slit at several locations at 48. The slits extend to the edge 46 of the fabric 44 in one direction, and terminate at 50 in the direction toward the seam 45 It is to be appreciated that the end of the slits 50 are short of the seam 45 and are positioned inwardly from the peripheral region edge 38 by approximately ¼" in a commercial embodiment. Only the fabric layer 44 is slit at 48 and the fabric 42 remains intact engaging the side 36 of the piece 30.

Figure 6:
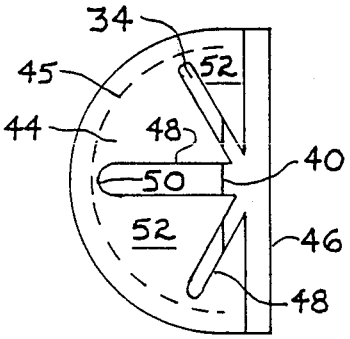
FIG. 6 illustrates the inner side of the base piece after the fabric is pulled over the peripheral lip region.

After the fabric 44 is slit as shown in FIG. 5 the resultant triangular portions 52 are pulled around the peripheral region 38 to enclose the edge 38 of the piece 30, and the edge of the fabric 42. This relationship is shown in FIG. 6 wherein the tensioning of the portions 52 as they are pulled over the peripheral region 38 will widen the slits 48 as shown in FIG. 6 and the fabric 44 will closely conform to the peripheral region 38.

Figure 7:
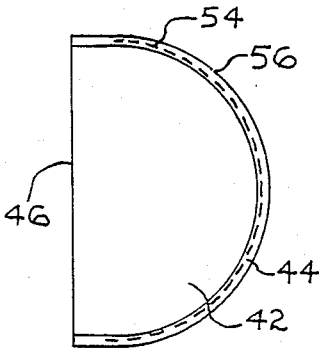
FIG. 7 is a view of the base material piece outer side after the tacking seam has been sewn.
Figure 8:
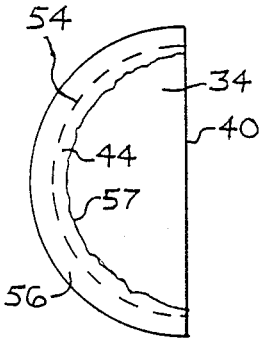
FIG. 8 illustrates the inner side of the base material piece after the extraneous portions of the pulled over fabric have been removed by trimming.
Figure 9:
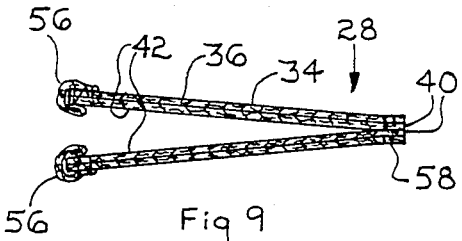
FIG. 9 is an elevational sectional view illustrating the base material pieces superimposed upon each other after the hinge seam has been sewn.

After the triangular portions 52 have been stretched over the peripheral region 38 a seam 54 is stitched through the piece 30 and the fabrics 42 and 44 to maintain the stretched condition of the fabric 44 and that portion of the fabric 44 extending over peripheral region 38 defines a bead 56 as apparent in FIGS. 7 and 9. After the seam 54 is applied the triangular portions 52 may be trimmed to produce the cut line 57, FIG. 8.

At this stage, or earlier, the material 42 and 44 intermediate the linear peripheral region 40 and the cut line 46 may be trimmed along the edge region 40 and it will be appreciated that the basic configuration of the assembly of the piece 30 and the fabrics 42 and 44 has the configuration of the piece 30.

After base materials 30 and 32 are identically prepared and in the form of FIG. 8 they are superimposed upon each other as shown in FIG. 9 wherein the peripheral edge regions 38 are in alignment, and the edge regions 40 are also aligned.

Upon the pieces 30 and 32 being superimposed, as in FIG. 9, a hinge seam 58 is applied across the pieces 30 and 32 substantially parallel to the peripheral region 40 and slightly inwardly displaced therefrom. The seam 58 will substantially extend across the diameter of the pieces 30 and 32.

Figure 10:
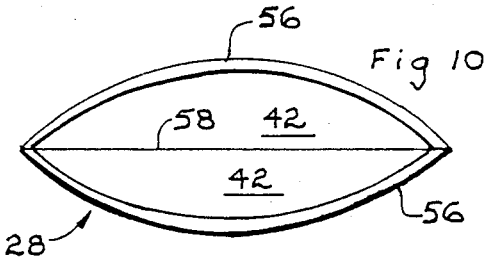
FIG. 10 is an elevational view as taken from the left of FIG. 9 illustrating the mouth base material pieces in an opened position.
Figure 11:
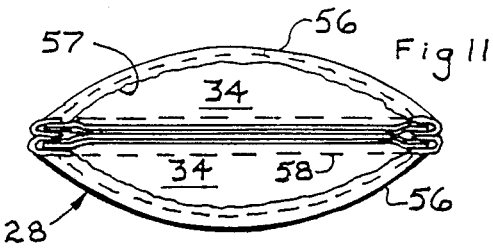
FIG. 11 is an elevational view of the assembled base material pieces of FIG. 9 as taken from the right illustrating the pieces in a partially open position.

The mouth assembly 28 is now completed. The pieces 30 and 32 may be "opened" as shown in FIGS. 10 and 11, and this position is natural in view of the pinching and compression that takes place at the seam 58. The base material pieces 30 and 32 are effectively hinged about the seam 58 and the pieces may be easily pivoted relative to each other about the hinge seam.

The assembly 28 is placed within the puppet head 10 within the mouth opening 16 and the exposed base material inner sides 34 are glued or otherwise affixed to the mouth plates 22 and 24 as will be apparent from FIG. 1. The mouth assembly 28 is so positioned upon the mouth plates 22 and 24 that the beads 56 overlap the lip regions 18 and 20 adjacent the mouth opening an the beads have the appearance of lips. In this manner the mouth assembly 28 completely encloses the mouth opening 16.

The mouth assembly 28 is easily manipulated by the operator inserting a hand 60 into the puppet head hand opening114 wherein the fingers 62 engage the plate 22 and the thumb 64 bears upon the plate 24. The tendency for the mouth to be in the "open" condition provides sufficient resiliency to permit the mouth pieces 30 and 32 to "open" when the pressure thereon is released, and the lip regions 18 and 20 aid in this motion.

As the base material pieces 30 and 32 are of a semi-rigid material the puppet mouth assembly 28 will maintain its shape at all times, and the puppet will tend to be continually "smiling" with an open mouth when not in use. By utilizing contrasting colors for the fabrics 42 and 44 an attractive color combination is achieved and the lip regions defined by the beads 56 will be well defined.

It is appreciated that various modifications to the inventive concepts may be apparent to those skilled in the art without departing from the spirit and scope of the invention.

I claim:

1. The method of forming the mouth of a puppet utilizing a semi-rigid sewable base material having a peripheral portion and first and second sides and first and second fabric layers, comprising, the steps of:

(a) layering the fabric layers upon each other and upon a pair of substantially identical pieces of the base material whereby the first fabric layer is adjacent the first base material side, (b) affixing the fabric layers to the base material pieces adjacent the peripheral portion to form a pair of assemblies, (c) cutting both fabric layers to fit adjacent the base material peripheral portion in conformation thereto, (d) slitting the second fabric layer with a plurality of slits extending from adjacent the base material peripheral portion to the edge of the second fabric layer which is substantially opposed to the base material peripheral portion, (e) folding the second layer slit portions over the base material second side to enclose the base material peripheral portion, (f) affixing the second fabric layer to the base material second side adjacent the peripheral portion, (g) superimposing the pair of base material and fabric layer assemblies upon each other with the peripheral portions aligned and the base material first sides disposed toward each other, and (h) attaching the pair of assemblies to each other adjacent the base material edges opposed to the base material peripheral portions to define a hinge.

2. The method of forming the mouth of a puppet as in claim 1, wherein the step of affixing the fabric layers to the base material pieces comprises sewing a seam.

3. The method of forming the mouth of a puppet as in claim 2, wherein the step of affixing the second layer to the base material second side comprises sewing a seam.

4. The method of forming the mouth of a puppet as in claim 1 wherein the step of attaching the pair of assemblies to each other comprises sewing a seam.

5. The method of forming the mouth of a puppet utilizing a semi-rigid sewable base material having a peripheral portion and first and second sides and first and second fabric layers wherein the puppet includes a mouth opening having upper and lower flexible lip regions comprising the steps of:

(a) layering the fabric layers upon each other and upon a pair of substantially identical pieces of the base material whereby the first fabric layer is adjacent the first base material side, (b) affixing the fabric layers to the base material pieces adjacent the peripheral portion to form a pair of assemblies, (c) cutting both fabric layers to fit adjacent the base material peripheral portion in conformation thereto, (d) slitting the second fabric layer with a plurality of slits extending from adjacent the base material peripheral portion to the edge of the second fabric layer which is substantially opposed to the base material peripheral portion, (e) folding the second layer slit portions over the base material second side to enclose the base material peripheral portion, (f) affixing the second fabric layer to the base material second side adjacent the peripheral portion, (g) superimposing the pair of base material and fabric layer assemblies upon each other with the peripheral portions aligned and the base material first sides disposed toward each other, (h) attaching the pair of assemblies to each other adjacent the base material edge opposed to the base material peripheral portions to define a hinge, (i) affixing an internally extending mouth plate to each mouth opening lip region, and (j) bonding the attached base material pieces second sides to the mouth plates to close the mouth opening.

6. The method of forming the mouth of a puppet as in claim 5 wherein the step of affixing the mouth plates to the lip regions comprises sewing a seam.

* * * * *